United States Patent [19]

Gould

[11] 4,322,860

[45] Apr. 6, 1982

[54] POOL CLEANING HEAD WITH ROTARY POP-UP JET PRODUCING ELEMENT

[75] Inventor: Henry D. Gould, Phoenix, Ariz.

[73] Assignee: Shasta Industries, Inc., Phoenix, Ariz.

[21] Appl. No.: 194,679

[22] Filed: Oct. 6, 1980

[51] Int. Cl.[3] ..... E04H 3/20

[52] U.S. Cl. ..... 4/490; 134/167 R; 239/66; 239/204; 239/206

[58] Field of Search ..... 4/490; 134/167 R; 239/204, 206, 205, 66

[56] References Cited

U.S. PATENT DOCUMENTS

| | | | |
|---|---|---|---|
| 1,964,269 | 6/1934 | Munz | 239/204 X |
| 2,845,302 | 7/1958 | Hanf | 239/204 X |
| 3,408,006 | 10/1968 | Stanwood | 239/66 |
| 3,515,351 | 6/1970 | Costa | 239/206 |
| 4,188,673 | 2/1980 | Carter | 4/490 X |
| 4,200,230 | 4/1980 | Gould | 239/66 |
| 4,212,088 | 7/1980 | Goettl et al. | 4/490 |
| 4,271,541 | 6/1981 | Mathews | 4/490 |

*Primary Examiner*—Henry K. Artis

*Attorney, Agent, or Firm*—Cahill, Sutton & Thomas

[57] ABSTRACT

A cleaning head for installation in the bottom surface of a swimming pool includes a rotary pop-up jet producing element having a hollow cylindrical lower section open at its bottom and an enlarged cylindrical hollow upper section closed at its top. An outlet opening is disposed in a vertical cylindrical wall of the upper section. A camming pin extending from the vertical cylindrical wall of the lower section engages opposed, staggered upper and lower sawtooth-like camming surfaces disposed along an inner cylindrical wall of a stationary section of the cleaning head. The stationary section of the cleaning head sealably engages with a housing installed in the bottom surface of the swimming pool and is sealably coupled to an intermittent high pressure water supply. As the water pressure is intermittently pressurized, the pop-up jet producing element pops up and down, the camming pin engages upper and lower edges of the saw-tooth-like camming elements, causing the rotary pop-up element to rotate intermittently each time the water pressure is turned on and off. Each time the water pressure is turned on, a jet of water is ejected from the outlet opening, which is exposed above the edge of the housing as the pop-up jet producing element pops up. Each time the water pressure is turned off, the jet producing element is retracted into the housing so that the top of the upper section is flush with the bottom of the pool.

15 Claims, 5 Drawing Figures

POOL CLEANING HEAD WITH ROTARY POP-UP JET PRODUCING ELEMENT

SUMMARY OF THE INVENTION

1. Field of the Invention

The invention relates to cleaning heads for use in the bottoms of swimming pools, and more particularly, to cleaning heads which eject jets of water in successive angular directions about a center point along the bottom of a swimming pool as water pressure applied to the cleaning head is intermittently cycled on and off.

2. Description of the Prior Art

A variety of automatic pool cleaning systems have been devised to ease the task of maintaining swimming pool surfaces free of settled debris. Some known systems utilize a plurality of "cleaning heads" disposed along bottom surfaces of swimming pools, wherein the cleaning heads have a large number of outlet openings disposed in a single plane so that successive jets of water are ejected along the bottom surfaces of a swimming pool to loosen settled debris from the bottom surface thereof. This enables the loosened debris to be easily advanced toward a drain located in the deepest portion of the swimming pool and drawn into a filter in the system which removes the debris from the water. A pool cleaning head of this type described is disclosed in U.S. Pat. No. 3,408,006, wherein the disclosed cleaning head includes a housing having two interspaced, staggered rings of saw-tooth-like camming surfaces or teeth disposed along an inner surface of a cylinder into which a piston or plunger having a pair of pins extending outwardly into the spaces between the teeth pop up and down as water pressure applied to the cleaning head is alternately cycled from zero pressure to a high pressure. Each time the water pressure is cycled, one of the pins engage a sloped upper or lower one of the camming surfaces and slides along that camming surface so that an outlet orifice in the upper end of the piston's vertical wall registers with a successive one of outlet openings, through which a jet of water is ejected.

However, the cleaning head disposed in U.S. Pat. No. 3,408,006 has several significant disadvantages, one being that the portion of the device in which the above-mentioned outlet openings are radially disposed always extends above the bottom surface of the pool, regardless of whether or not the cleaning head is being operated. Consequently, swimmers using the pool frequently stub their toes as they walk along the bottom surface of the swimming pool. Another disadvantage of the device of U.S. Pat. No. 3,408,006 is that a number of its features cause it to be unduly complex and expensive to manufacture.

Accordingly, it is an object of the invention to provide a cleaning head for installation along surfaces of a liquid container, such as a bottom surface of a swimming pool, wherein the cleaning head has an upper surface which is flush with the surface in which the cleaning head is installed if the cleaning head is not presently being operated.

It is another object of the invention to provide a pool cleaning head which avoids injury to the toes of swimmers.

Another disadvantage of the cleaning head described in U.S. Pat. No. 3,408,006 is that the structure of the outlet ports and the structure of the upper portion of the plunger and orifice in the plunger results in inefficient flow of water therethrough, producing turbulence which excessively limits the distance or extent of the jets of water ejected therefrom, thereby reducing the cleaning capability of the cleaning head. The high degree of turbulence of water moving through the upper portion of the plunger toward the elongated vertical orifice therein produces further turbulence in water as it approaches the orifice, preventing an efficient, narrow, high velocity jet of water from being formed and emitted from the orifice. The webs between the adjacent ports result in further frictional drag upon the emitted jet of water.

It is therefore another object of the invention to provide a pool cleaning head which more efficiently cleans the bottom of a swimming pool than the device described in U.S. Pat. No. 3,408,006 and is capable of cleaning a larger portion of the bottom of the swimming pool.

Another object of the invention is to provide a pool cleaning head having a more efficient "nozzling effect" upon ejected water than prior pool cleaning heads, enabling the cleaning head to produce more powerful jets of water which penetrate further along the bottom surface of the swimming pool than jets of water produced by prior pool cleaning Another disadvantage of the device of U.S. Pat. No. 3,408,006, relating to its complexity of structure, is the need to prevent a plunger retracting spring from "winding up" as the plunger rotates. Furthermore, the construction of the plunger is made more complex by the necessity of providing a large number of slots or holes in the lower portion thereof adjacent to the spring to prevent debris from collecting and interfering with the spring operation by allowing pressurized water to flow between the springs.

Another object of the invention is to provide a pool cleaning head which overcomes the foregoing shortcomings of the prior art.

SUMMARY OF THE INVENTION

Figure 1:
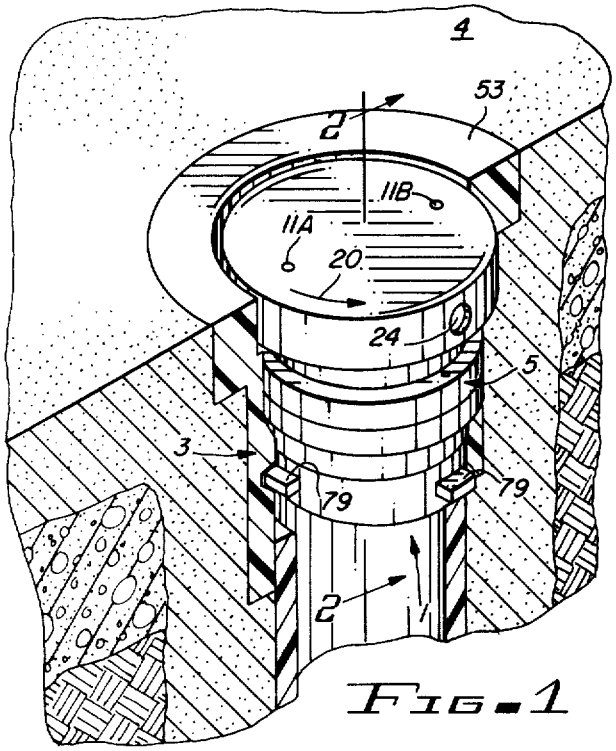
FIG. 1 is a partial cutaway perspective view of the cleaning head of the present invention.

Briefly described, and in accordance with one embodiment thereof, the invention provides a pop-up cleaning head for installation within a housing coupled to a pressurized fluid source and installed in a surface of the container which is to be cleaned. The cleaning head includes an outer cylinder connected in sealed relationship with the housing and a rotary pop-up jet producing element having a cylindrical lower portion which moves as a piston within the cylinder. The lower portion of the rotary pop-up element (hereinafter, simply the "pop-up element") is hollow and has an open lower end into which pressurized fluid moves. The upper portion of the pop-up element has an enlarged shallow cylindrical upper portion which is also hollow and is continuous with the lower portion. The upper portion is sealed by means of a top plate. A pair of opposed, staggered sawtooth-like rings are concentrically disposed along the inner surface of the cylinder within which the lower portion of the pop-up element moves. A pin extending through the lower portion of the pop-up element and out of opposite sides of the cylindrical wall thereof extends between the teeth of the two staggered camming rings. When fluid at high pressure is forced into the hollow region bounded by the pop-up element, the resulting upward force causes the pop-up element to raise or pop up, so that a single outlet opening in the cylindrical wall thereof rises above the level of an upper lip of the housing which is flush with the bottom of a swimming pool in the described embodiment of the invention. When the pop-up element is in its lower position, the top plate of the upper portion of the pop-up element is also flush with the bottom surface of the swimming pool. As the pop-up element is forced upward by pressurized water, each camming pin strikes an inclined edge or camming surface of the upper camming ring, causing the pop-up element to rotate through a predetermined angle, the camming pin and the camming surface determining the amount of such rotation. The extent of upward travel of the pop-up element is determined by mating surfaces of the outer cylinder and the lower portion of the pop-up element. A high pressure jet of water produced by relatively low turbulence flow of water in the enlarged upper portion of the rotary pop-up element extends a substantial distance along the surface of the swimming pool bottom until such time as the applied water pressure from the pressurized fluid source (i.e., the swimming pool water pump) is reduced essentially to zero. A spring mechanism attached to the rotary pop-up element then quickly forces the pop-up element to its lower position so that the top plate of the pop-up element is flush with the upper edge of the housing (and the bottom surface of the swimming pool), simultaneously causing the camming pin to engage a lower inclined surface of the lower camming ring, further rotating the rotary pop-up element to a subsequent position aligned with the upper camming ring so that the next upward movement of the pop-up element causes the camming pin to engage a subsequent inclined camming surface of the upper ring, advancing the rotary pop-up element to the position from which the next jet of water will be ejected. The spring mechanism includes a rod attached to the lower surface of the top plate extending axially from the top of the upper chamber to the lower portion of the outer cylinder beneath the opening at the lower end of the pop-up element. The coil spring is disposed between a lower washer (which engages with and rotates with the vertical shaft) and an upper washer, which is retained by a cross member attached to the outer, stationary cylinder. Flow of pressurized water around the spring and washers prevents debris from collecting around the spring and interferring with operation thereof. The upper and lower washers rotate at the same rate that the rotary pop-up element rotates, preventing "winding" of the spring. The upper washer rotates with negligible friction against the lower surface of the cross member.

DESCRIPTION OF THE INVENTION

Referring now to the drawings, cleaning head 1 is installed within a housing 3. Housing 3 is installed so that its upper lip 53 is flush with the bottom surface 4 of a swimming pool. Housing 3 has a roughly cylindrical configuration having an enlarged upper portion with a larger diameter than the lower portion. A horizontal step 55 is disposed between the upper and lower portions of housing 3. A still lower portion of housing 3 has a sloped surface 85, by means of which an "O-ring" 83 produces a sealed relationship between the cleaning head (subsequently described) and housing 3. A plurality of slots 81 are disposed in an even lower portion of housing 3 for receiving tabs 79 of the pool cleaning head 1, so that pool cleaning head 1 can be removed from housing 3. A pipe 91 (FIG. 3) leading to an intermittent high pressure water source is sealably connected to the lowest portion of housing 3 for conducting high pressure water into housing 3, wherefrom it flows into a hollow interior portion 13', 19' of pool cleaning head 1, as subsequently explained.

Figure 3:
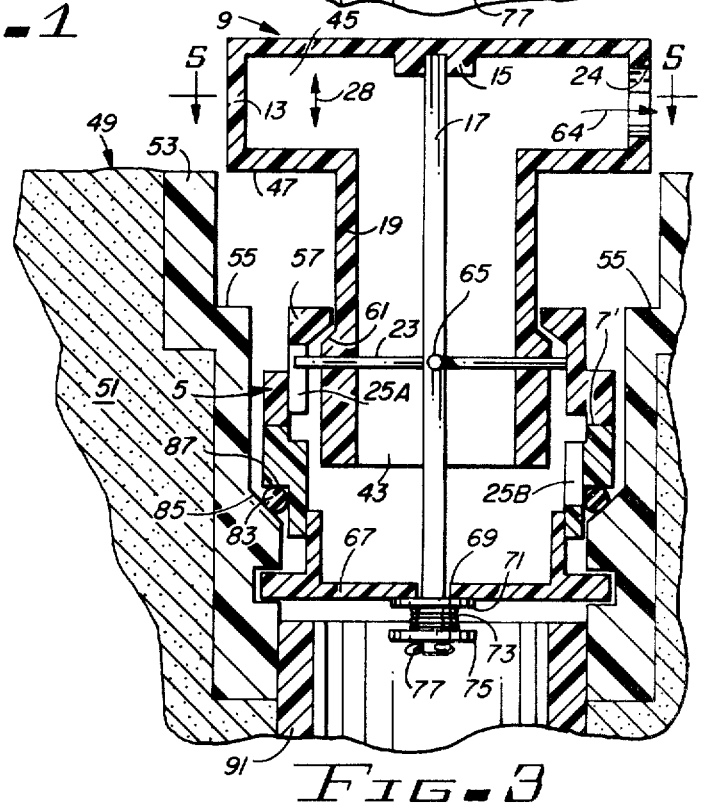
FIG. 3 is a sectional view similar to that shown in FIG. 2, except that the rotary pop-up jet producing element is in its elevation position.
Figure 5:
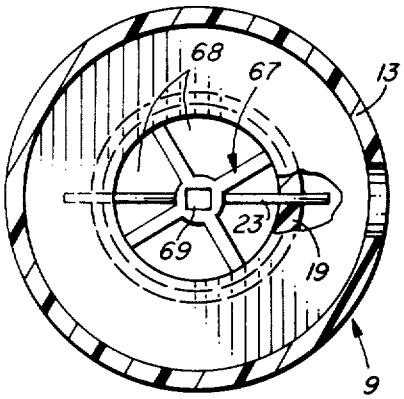
FIG. 5 is a partial sectional view taken along section line 5—5 of FIG. 3.

Cleaning head 1 includes a pop-up rotary jet producing element designated by reference numeral 9. Pop-up element 9 includes a cylindrical upper section having an enlarged cylindrical wall 13 and a top plate 11 bounding a hollow region 13'. Pop-up element 9 also includes a lower portion having a cylindrical wall 19, surrounding a lower hollow volume 19' which is continuous with volume 13'. The lower end of cylindrical wall 19 terminates at a bottom opening 43 (FIG. 3), through which pressurized water can enter volume 13', 19'. An outlet opening 24, which may have a diameter of approximately one-half inch, is disposed in cylindrical wall 13. As subsequently explained, when pop-up element 9 is in its elevated position, due to forcing of high pressure water into the lower end of housing 3, as shown in FIG. 3, a high pressure jet of water is ejected out of outlet opening 24 along the surface 4 of the swimming pool, loosening debris on the surface of the floor and mixing it with adjacent water of the swimming pool. As the water pressure is intermittently cycled on and off, pop-up element 3 rotates intermittently in the direction indicated by arrow 26 (FIG. 1) by an amount corresponding to the distance between successive teeth of cam ring 25A of FIG. 4, as subsequently explained.

Figure 2:
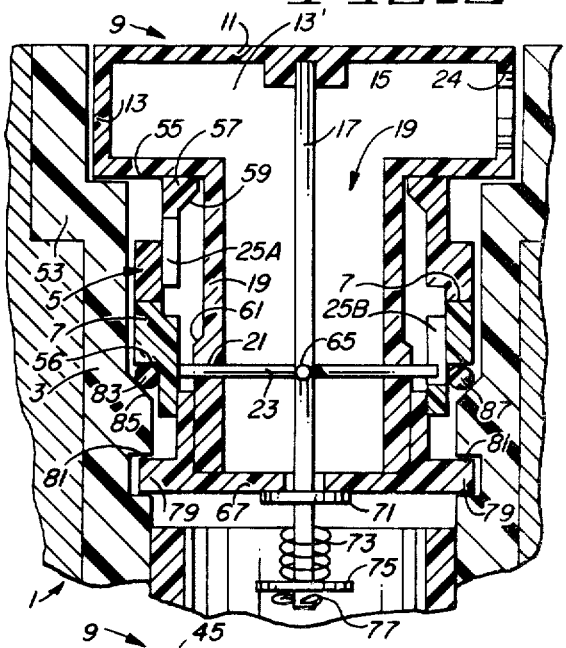
FIG. 2 is a sectional view taken along section line 2—2 of FIG. 1, with the rotary pop-up jet producing element in its lowered position.
Figure 4:
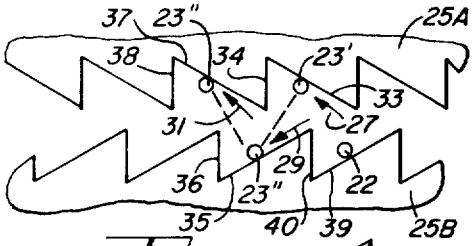
FIG. 4 is a plan view showing the portion of the saw-tooth-like camming surfaces which produces indexing of the rotary pop-up jet producing element of the cleaning head.

As best seen in FIGS. 2 and 3, outer cylinder 7 functions as a cylinder within which pop-up element 9 rotates and vertically reciprocates. Outer cylinder 7, which may be composed of two injection molded plastic sections joined at line 5 in FIG. 2, includes two inner camming rings 25A and 25B, portions of which are shown in FIG. 4. In FIG. 2, reference numeral 25B designates the lower camming ring and reference numeral 25A designates the upper camming ring. The upper portion of cylinder 7 has an upper shoulder 57 having a concentric inclined surface 59 against which a correspondingly sloped surface 61 of the bottom portion of cylindrical wall 19 abuts to limit the upward travel of pop-up element 9, as also seen in FIG. 3. Step 55 of cylinder 7 limits the downward travel of pop-up element 3.

As seen in FIGS. 2 and 3, the previously mentioned O-ring 83 is wedged between a step 56 of outer cylinder 7 and inclined surface 85 of the lower portion of housing 3. O-ring 83 prevents high pressure water forced into cleaning head 9 through pipe 91 from leaking into the swimming pool along the space between the outer portion of cleaning head 9 and the inner walls of housing 3.

A camming pin 23 extends through a hole 65 in vertical shaft 17 and extends through sealed holes in wall 19 into the space between the respective teeth of camming rings 25A and 25B, as best seen in FIG. 4.

Vertical rod 17 is attached to portion 15 of top plate 11 of pop-up element 9. Rod 17 extends through the bottom opening 17 of pop-up element 9 and through a guide-hole 69 of a cross member 67, which is rigidly attached to the bottom of outer cylinder 7. Cross member 67 has a plurality of openings 68 to provide adequate support for shaft 17 (to prevent lateral displacement thereof) and yet allow free flow of pressurized water from pipe 91 into the volume 19', 13' bounded by pop-up element 9.

Hole 69 provides sufficient clearance with respect to shaft 17 that shaft 17 can freely slide vertically through hole 69, as subsequently explained. A coil spring 73 is disposed between an upper washer 71 and a lower washer 75. Lower washer 75 is retained on the lower end of shaft 17 by means of a cotter pin 77. Washer 75 and washer 71 have square, centrally located holes therein, and shaft 17 has a square cross-section, so that washers 75 and 71 rotate at the same rate that pop-up element 9 rotates. This prevents spring 73 from "winding" as pop-up element 3 rotates. The upper surface of washer 71 provides a low friction surface which easily rotates against the lower surface of cross-member 67.

If pool cleaning head 1 is inoperative, due to the absence of water pressure from pipe 91 (FIG. 3), then pop-up element 9 is in the configuration shown in FIG. 2, with its top plate 11 flush with surface 4 (FIG. 1) of the swimming pool. If the water pressure from pipe 91 is then increased from zero to a high value (such as is ordinarily obtained from a swimming pool pump), then jet producing element 9 rapidly moves upward to the configuration shown in FIG. 3 (so that a high pressure jet of water is ejected from outlet opening 24), as indicated in FIG. 3. Referring now mainly to FIG. 4, as jet producing element 9 moves upward, one end of cam engaging pin 23 moves upward from the position indicated by reference numeral 22 in FIG. 4 until it strikes inclined cam surface 33. As the end of cam engaging pin 23 rises further (until sloped surfaces 61 and 59 meet to limit such upward movement), the end of pin 23 moves in the direction indicated by arrow 27, causing jet producing element 9 to rotate, as indicated by arrow 26 in FIG. 1. Pin 23 comes to rest at a point which is to the left of the peak between cam surfaces 39 and 25 in FIG. 4. Assume, then, after approximately 5 to 15 seconds, that the water pressure is cut off. Spring 73, which is compressed, as shown in FIG. 3, then expands, rapidly retracting jet producing element 9 downward into housing 3. This causes the end of cam engaging pin 23 to be rapidly lowered, engaging lower cam surface 35, and moving further to the left, in the direction indicated by arrow 29 to the position designated by reference numeral 23" in FIG. 4. As the end of pin 23 moves downward along lower cam surface 35, jet producing element 9 rotates further in the direction indicated by arrow 26, such that position 23" is to the left of the peak between upper cam surfaces 34 and 37, so that the next time the water pressure is increased (causing jet producing element 9 and pin 23 to rise), pin 23 strikes upper cam surface 37, causing pin 23 to rotate to the position indicated by reference numeral 23'''. This causes further rotation of jet producing element 9 to the direction in which the second high velocity jet of water is ejected from opening 24.

The approximate dimensions of the cleaning head shown in the drawings are approximately 2.5 inches for the diameter of upper section 13, approximately ⅝ of an inch for the height of upper section 13, approximately 1 3/16 of an inch for the diameter of lower section 19 and approximately 1½ inches for the height of lower section 19. The diameter of outlet opening 24 in the described embodiment of the invention is approximately ½ inch. These dimensions, of course, are not critical, and can be proportionately increased and varied, consistent with the following considerations. My experiments have shown that the provision of the enlarged upper section with cylindrical wall 13 and outer opening 24 therein produces a much higher velocity, more narrowly directed jet of water than would be possible if the outlet opening 24 were provided in an upper section having the same diameter as cylindrical wall 19, due to the fact that the enlarged structure of upper section 13 provides a much more turbulence-free conveying of water from region 19' toward outlet opening 24. By injecting high pressure water with bubbles into a transparent cleaning head, I have discovered that the water in the outer portions of upper volume 13' is nearly stationary, and that the nearly stationary water thereat serves to "funnel" high pressure water from region 19' through region 13' toward outlet opening 24, causing outlet opening 24, in combination with the nearly stationary water, to act as a highly efficient nozzle. This operation eliminates much of the turbulence which would be caused by friction with the sides of any substantially smaller diameter upper portion. Furthermore, elimination of the outlet ports (and webs therebetween) of the previously discussed device disclosed in U.S. Pat. No. 3,408,006 further reduces friction of the ejected water with the webs and also eliminates friction and the turbulence which results therefrom as water passes from the inner orifice to the outer adjacent outlet port of the device disclosed in U.S. Pat. No. 3,408,006.

The cleaning head disclosed herein is capable of producing a jet of water along the bottom surface of a swimming pool for a distance of approximately 8½ feet for an applied water pressure of twenty-five pounds per square inch. For this water pressure, the device disclosed in U.S. Pat. No. 3,408,006 can only produce a jet of approximately 7 feet. The improvement is due to the substantially more efficient outlet design and the enlarged upper region 13' of my cleaning head. Furthermore, it is impossible for a user of a swimming pool to stub his toe on my cleaning head (if the jet is not being ejected) due to the fact that the upper portion 13 is then in its retracted configuration so that its top plate 11 is flush with the surface of the swimming pool, thereby overcoming the previously described disadvantage of the protruding housing of the cleaning head disclosed in U.S. Pat. No. 3,408,006.

Note that all parts except pin 23, vertical rod 17, spring 73 and O-ring 83 are composed of plastic in the described embodiment of the invention.

It should be noted that pin 23 (which can be a stainless steel rod approximately one sixteenth inch in diameter) can be replaced with plastic tabs (not shown) which extend outward from the outer cylindrical wall 19 between cam rings 25A and 25B. Such plastic extensions can be integral with cylindrical wall 19, and can extend outward approximately one eighth of an inch therefrom. If the plastic extensions are approximately one eighth of an inch by one sixteenth of an inch and extend outward by one eighth of an inch, they will have sufficient strength to transmit enough force to the teeth of camming rings 25A and 25B to allow tabs 79 (FIG. 1) to engage the corresponding recessing in housing 3. This will allow a user to apply enough torque to top plate 11 to effect installation of cleaning head 1 in housing 3 or removal of cleaning head 1 from housing 3. Note that two recesses 11A and 11B are disposed in the top surface 11 of pop up element 9 for receiving a spanner wrench to apply the above mentioned torque to disengage tabs 79 from housing 1. The cleaning head 1 then can be "popped out" of housing 3 by merely applying increased water pressure via pipe 91.

It should also be noted that it is not necessary that the diameter of the lower section bonded by cylindrical wall 19 be less than the diameter of the upper section bonded by cylindrical wall 13. What is important is that the diameter of the upper section bonded by cylindrical wall 13 be sufficiently large to avoid substantial turbulence, as explained above, in the water flowing toward outlet opening 24 for the selected high water pressure and the selected size of outlet opening 24.

While the invention has been disclosed with reference to a particular embodiment thereof, those skilled in the art will be able to make various modifications to various elements of the disclosed structure without departing from the true spirit and scope of the invention, as set forth in the appended claims.

I claim:

1. A cleaning head for installation in a housing disposed in an under-liquid surface of a liquid container such as a swimming pool, the housing having an upper surface flush with the under-liquid surface, the housing receiving a pressurized liquid, the pressure of which is intermittently or periodically cycled between a relatively low pressure and a relatively high pressure, said cleaning head comprising in combination:

a. stationary means open at upper and lower ends thereof for removable connection in sealed relation to said housing;

pop-up jet producing means, having an outlet opening, rotatably, indexably disposed in said stationary means for moving outwardly from the under-liquid surface in response to said relatively high pressure to expose said outlet opening and produce a concentrated, high-velocity liquid jet along said under-liquid surface from said outlet opening; and c. retracting means connected to both said stationary means and said pop-up jet producing means for retracting said pop-up jet producing means when said liquid pressure is cycled from said relatively high pressure to said relatively low pressure, said pop-up jet producing means rotating to successive fixed positions in response to said cycling, thereby producing a plurality of successive concentrated, high velocity liquid jets to clean a circular pattern around said cleaning head.

2. The cleaning head of claim 1 further including fixed camming means attached to said stationary means and related camming means attached to said pop-up jet producing means, said fixed and related camming means being in engagement with each other causing rotation of said pop-up jet producing means relative to said stationary means each time said pop-up jet producing means moves outwardly from the under-liquid surface in response to said relatively high pressure and/or is retracted by said retracting means.

3. The cleaning head of claim 2 wherein said pop-up jet producing means includes a hollow, cylindrical lower section extending into said stationary means and a hollow, cylindrical, upper section attached to said lower section, the hollow regions bounded by said upper and lower sections being continuous, a top plate being attached to the upper end of said upper section in sealing relation therewith, the lower end of said lower section being open for receiving said pressurized fluid.

4. The cleaning head of claim 3 wherein said upper section includes a cylindrical wall and said upper section has said outlet opening disposed in said cylindrical wall.

5. The cleaning head of claim 4 wherein said outlet opening is circular.

6. The cleaning head of claim 4 wherein a diameter of said upper section is sufficiently greater than a diameter of said lower section to ensure that when the pressure of said liquid is equal to said relatively high pressure, portions of said liquid located in outer portions of said upper section adjacent to said cylindrical wall move relatively slowly to effectively aid guiding or funneling of more rapidly moving liquid flowing from said lower section through said upper section toward said outlet opening to produce a concentrated, high velocity liquid jet which is ejected from said outlet opening, said guiding or funneling reducing turbulence in said rapidly moving liquid as it moves toward said outlet opening, thereby resulting in increased velocity and concentration of said liquid jet.

7. The cleaning head of claim 1 wherein said housing, said stationary means, and said pop-up jet producing means are composed of plastic.

8. The cleaning head of claim 6 wherein said outlet opening has a diameter of approximately one-half inch.

9. The cleaning head of claim 3 wherein said retracting means includes a coil spring disposed beneath said lower section, connecting means for connecting a first end of said spring to said pop-up jet producing means, and means for engaging a second end of said spring with said stationary means, said coil spring being elastically deformed when said pop-up jet producing means moves outwardly from the under-liquid surface.

10. The cleaning head of claim 9 wherein said stationary means includes a member attached to the lower end of said lower section, said spring being disposed between first and second washers, the first washer being retained slidably against said member, said second washer being engaged with said connecting means, said spring being compressed when said pop-up jet producing means moves outwardly from the under-liquid surface.

11. The cleaning head of claim 1 wherein said stationary means is sealed with respect to said housing by means of an O-ring gasket disposed between an outer surface of said stationary means and an inner surface of said housing.

12. The cleaning head of claim 1 wherein said stationary means and said pop-up jet producing means each include means for limiting the outward travel of said pop-up jet producing means and for limiting the movement of said pop-up jet producing means during said retracting thereof by said retracting means.

13. The cleaning head of claim 4 wherein said fixed camming means includes first and second rings of saw-tooth-like teeth disposed in staggered relationship along a cylindrical inner surface of said stationary means, said related camming means including at least one pin extending from a wall of said lower section between said first and second rings.

14. The cleaning head of claim 3 wherein a diameter of said upper section is sufficiently large to prevent excessive turbulence in liquid moving from said lower section through said upper section to said outlet opening when said liquid is at said relatively high pressure.

15. The cleaning head of claim 13 wherein the area of said outlet opening is sufficiently large to effect a predetermined rate of flow of liquid through said outlet opening at said relatively high pressure.

16. The cleaning head of claim 2 wherein said stationary means includes tab means for removable engagement with said housing to effect said sealed relation, said housing having tab receiving means for receiving said tab means, said fixed camming means having sufficient strength to transmit enough force from said pop-up jet producing means to said fixed camming means to cause engagement and disengagement of said tab means with a tab receiving means.

* * * * *

US004322860B1

REEXAMINATION CERTIFICATE (2540th)

United States Patent [19]

Gould

[11] B1 4,322,860

[45] Certificate Issued Apr. 18, 1995

[54] POOL CLEANING HEAD WITH ROTARY POP-UP JET PRODUCING ELEMENT

[75] Inventor: Henry D. Gould, Phoenix, Ariz.

[73] Assignee: Shasta Industries, Inc., Phoenix, Ariz.

Reexamination Request:
No. 90/002,879, Nov. 6, 1992

Reexamination Certificate for:

| | |
|---|---|
| Patent No.: | **4,322,860** |
| Issued: | **Apr. 6, 1982** |
| Appl. No.: | **194,679** |
| Filed: | **Oct. 6, 1980** |

[51] Int. Cl.[6] ..... E04H 4/16

[52] U.S. Cl. ..... 4/490; 134/167 R; 239/66; 239/204; 239/206

[58] Field of Search ..... 4/490, 492; 239/204, 239/205, 206

[56] References Cited

U.S. PATENT DOCUMENTS

| | | | |
|---|---|---|---|
| 1,964,269 | 6/1934 | Munz . | |
| 2,214,852 | 9/1940 | Lacy-Mulhall . | |
| 2,678,845 | 5/1954 | Fitter . | |
| 2,793,908 | 5/1957 | Carver, Jr. . | |
| 2,845,302 | 7/1958 | Hanf . | |
| 2,912,111 | 11/1959 | Kovac | 239/204 X |
| 3,018,788 | 6/1962 | Perlis . | |
| 3,239,149 | 3/1966 | Lindberg, Jr. | 4/507 |
| 3,301,489 | 1/1967 | Tropeano et al. . | |
| 3,408,006 | 10/1968 | Stanwood . | |
| 3,449,772 | 6/1969 | Werner . | |
| 3,506,489 | 4/1970 | Baker . | |
| 3,515,351 | 6/1970 | Costa . | |
| 3,521,304 | 7/1970 | Ghiz . | |
| 3,675,252 | 7/1972 | Ghiz . | |
| 3,770,203 | 11/1973 | Dyar . | |
| 3,934,820 | 1/1976 | Phaup . | |
| 4,188,673 | 2/1980 | Carter . | |
| 4,200,230 | 4/1980 | Gould . | |
| 4,212,088 | 7/1980 | Goettl . | |
| 4,271,541 | 6/1981 | Mathews . | |
| 4,371,994 | 2/1983 | Mathews . | |

*Primary Examiner*—Henry J. Recla

[57] ABSTRACT

A cleaning head for installation in the bottom surface of a swimming pool includes a rotary pop-up jet producing element having a hollow cylindrical lower section open at its bottom and an enlarged cylindrical hollow upper section closed at its top. An outlet opening is disposed in a vertical cylindrical wall of the upper section. A camming pin extending from the vertical cylindrical wall of the lower section engages opposed, staggered upper and lower sawtooth-like camming surfaces disposed along an inner cylindrical wall of a stationary section of the cleaning head. The stationary section of the cleaning head sealably engages with a housing installed in the bottom surface of the swimming pool and is sealably coupled to an intermittent high pressure water supply. As the water pressure is intermittently pressurized, the pop-up jet producing element pops up and down, the camming pin engages upper and lower edges of the saw-tooth-like camming elements, causing the rotary pop-up element to rotate intermittently each time the water pressure is turned on and off. Each time the water pressure is turned on, a jet of water is ejected from the outlet opening, which is exposed above the edge of the housing as the pop-up jet producing element pops up. Each time the water pressure is turned off, the jet producing element is retracted into the housing so that the top of the upper section is flush with the bottom of the pool.

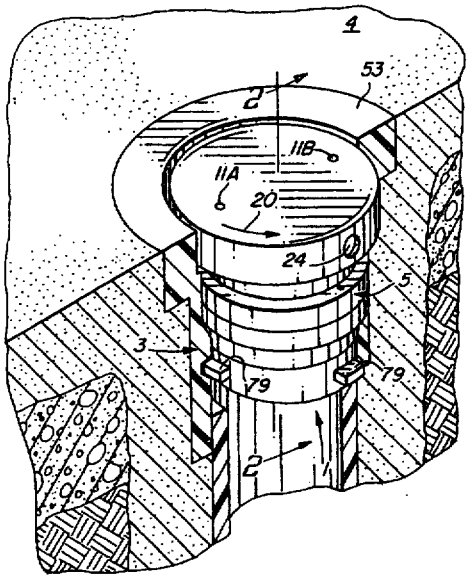

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1–5, 7, and 9–16 are cancelled.

Claim 6 is determined to be patentable as amended.

Claim 8, dependent on an amended claim, is determined to be patentable.

6. [The cleaning head of claim 4 wherein] *A cleaning head for installation in a housing disposeed in an under-liquid surface of a liquid container such as a swimming pool, the housing having an upper surface flush with the under-liquid surface, the housing receiving a pressurized liquid, the pressure of which is intermittently or periodically cycled between a relatively low pressure and a relatively high pressure, said cleaning head comprising in combination:*

*a. stationary means open at upper and lower ends thereof for removable connection in sealed relation to said housing;*

*b. pop-up jet producing means, having an outlet opening, rotatably, indexably disposed in said stationary means for moving outwardly from the under-liquid surface in response to said relatively high pressure to expose said outlet opening and produce a concentrated, high-velocity liquid jet along said under-liquid surface from said outlet opening; and*

*c. retracting means connected to both said stationary means and said pop-up jet producing means for retracting said pop-up jet producing means when said liquid pressure is cycled from said relatively high pressure to said relatively low pressure, said pop-up jet producing means rotating to successive fixed positions in response to said cycling, thereby producing a plurality of successive concentrated, high velocity liquid jets to clean a circular pattern around said cleaning head;*

*d. fixed camming means attached to said stationary means and related camming means attached to said pop-up jet producing means, said fixed and related camming means being in engagement with each other causing rotation of said pop-up jet producing means relative to said stationary means each time said pop-up jet producing means moves outwardly from the under-liquid surface in response to said relatively high pressure and/or is retracted by said retracting means;*

*e. said pop-up jet producing means includes a hollow, cylindrical lower section extending into said stationary means and a hollow, cylindrical, upper section attached to said lower section, the hollow regions bounded by said upper and lower sections being continuous, a top plate being attached to the upper end of said upper section in sealing relation therewith, the lower end of said lower section being open for receiving said pressurized fluid;*

*f. said upper section includes a cylindrical wall and said upper section has said outlet opening disposed in said cylindrical wall;* g. a diameter of said upper section is sufficiently greater than a diameter of said lower section to ensure that when the pressure of said liquid is equal to said relatively high pressure, portions of said liquid located in outer portions of said upper section adjacent to said cylindrical wall move relatively slowly to effectively aid guiding or funneling of more rapidly moving liquid flowing from said lower section through said upper section toward said outlet opening to produce a concentrated, high velocity liquid jet which is ejected from said outlet opening, said guiding or funneling reducing turbulence in said rapidly moving liquid as it moves toward said outlet opening, thereby resulting in increased velocity and concentration of said liquid jet.

* * * * *